US006021929A

United States Patent [19]

Saito et al.

[11] Patent Number: 6,021,929

[45] Date of Patent: Feb. 8, 2000

[54] NOZZLE FOR MAKING STEEL AND METHOD FOR MANUFACTURING THE SAME

[76] Inventors: Masanobu Saito; Toshio Yamane; Seijiro Tanaka, all of c/o Kawasaki Refractories Co., Ltd. 2-1576-banchi, Higashioki Aza, Nakahiro, Ako-shi, Hyogo-ken, Japan

[21] Appl. No.: 08/924,733

[22] Filed: Sep. 5, 1997

[51] Int. Cl.[7] ..... B22D 35/00

[52] U.S. Cl. ..... 222/606; 501/103

[58] Field of Search ..... 501/103, 104; 222/590, 606, 607; 266/280, 286

[56] References Cited

U.S. PATENT DOCUMENTS 4,360,598 11/1982 Otagiri et al. ..... 501/103
5,073,689 12/1991 Tabata et al. ..... 219/10.491

OTHER PUBLICATIONS

Abstract of Japanese Patent JP403198841A Masaaki et al, Aug. 1991.
Abstract of Japanese Patent JP402263762A Itaru et al, Oct. 1990.

*Primary Examiner*—Scott Kastler

[57] ABSTRACT

A funnel shaped nozzle and a method for manufacturing the same, in which the nozzle is easily manufactured at a low cost, reduced in destabilization of a base material and has a high corrosion resistance. In carrying out the invention, a baked nozzle mainly composed of completely, or partially-stabilized zirconia, is impregnated with a solution that allows unstabilized zirconia to be precipitated or separated by heat. By heating the nozzle and coating an open surface of a component particle of base material with unstabilized zirconia, a nozzle reduced in destabilization of a base material and having a high corrosion resistance is obtained. As it is not required to produce a two-layered molding, production is facilitated, and a manufacturing cost is reduced, because a small amount of unstabilized zirconia is used.

8 Claims, 1 Drawing Sheet

【Fig. 1】
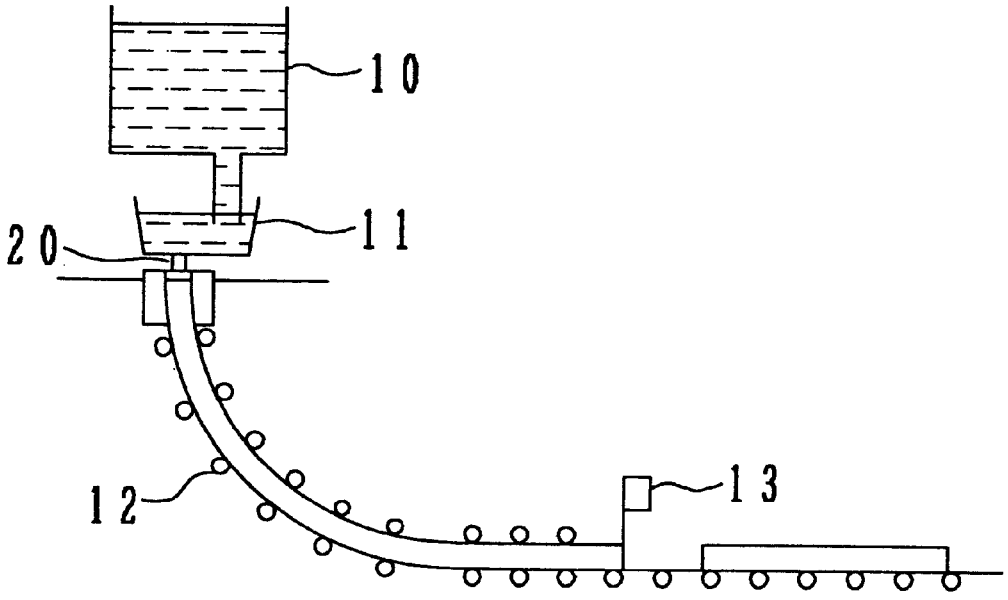

NOZZLE FOR MAKING STEEL AND METHOD FOR MANUFACTURING THE SAME

FIELD OF THE INVENTION

The present invention relates to a nozzle for making steel, particularly a nozzle for making steel that can be easily obtained at a low cost, prevents destabilization of a base material, and is high in corrosion resistance, more particularly a funnel and a method for manufacturing the same.

BACKGROUND OF THE INVENTION

FIG. 1 shows a concept of steel making equipment using a continuous casting method. A molten iron supplied from a blast furnace to a funnel 10 is fed through a funnel shaped nozzle 11 to a casting mold, and forced to be pulled out of the casting mold by a group of rollers 12 when the iron reaches a certain hardness. Then, the iron is processed to an appropriate thickness by a plurality of roller, and cut by a cutter 13.

In such case, the molten iron is supplied from the funnel to the tundish funnel shaped nozzle tube 11 by means of a tube in a sliding tube plate, and from the funnel shaped nozzle 11 to the casting mold also by means of a tube from the funnel shaped nozzel 11.

As described above, in various nozzles used for steel making, for example, a funnel shaped nozzle, because a flow rate of molten steel is controlled by an inner diameter thereof, a very high corrosion resistance is required. Therefore, as a material of the nozzle, zircon ($ZrSiO_4$) is employed for a low continuous-continuous application, and zirconia ($ZrO_2$) for a high continuous-continuous application. Further, a nozzle incorporating a dense zirconia pipe of densified structure has been developed for a high corrosion resistance.

Incidentally, zirconia demonstrates significant contraction and expansion due to phase transition between monoclinic and tetragonal phases at about 1000° C. It is, therefore, required to change it to such stable phase as tetragonal or cubic phase by adding an appropriate amount of such stabilizer as calcium oxide (CaO), magnesium oxide (MgO) and yttrium oxide ($Y_2O_3$).

Although CaO and MgO are employed mainly among the stabilizers, it is a problem that zirconia stabilized by CaO or MgO is destabilized as it reacts to a component of molten steel, and is progressively corroded.

On the other hand, although zirconia stabilized by $Y_2O_3$ is hardly destabilized, and is superior in corrosion resistance, it is very expensive in comparison with CaO and MgO, and it is difficult, in terms of economy, to form an entire nozzle using such $Y_2O_3$-stabilized zirconia.

In order to solve the problem, such a nozzle has been developed that $Y_2O_3$-stabilized zirconia is used only in a bore, or a dense partially-stabilized zirconia pipe is incorporated in a base material.

However, in such a nozzle with $Y_2O_3$-stabilized zirconia used only in a bore as described, because the coefficient of heat contraction in a bore portion formed by the $Y_2O_3$ partially-stabilized zirconia is different from that in the other portion, it is a problem that cracking is caused during baking, and molding is difficult, since it is required to form a two-layered molding.

In addition, in a nozzle incorporating a dense partially-stabilized zirconia pipe described above, preheating to a high temperature is required prior to use because of an inferior resistance to thermal shock, and it is a problem that molten steel may enter a joint portion, as the pipe is joined with a base material by means of mortar.

Thus, prior to the invention, although it was attempted to provide a nozzle at a low cost that is prevented from being cracked during baking, and can be easily molded by coating a working surface of a bore with a partially-stabilized zirconia, for example, using thermal spraying, it was found that separation and cracking of the coating layer may be caused, since a contact area between the coating layer and base material is large, and molten steel may enter through the cracks.

In view of such problems, it is an object of the invention to provide a nozzle adapted to easily increase a corrosion resistance at a low cost and a method for manufacturing the nozzle.

SUMMARY OF THE INVENTION

The invention is carried out in the light of the above object. In summary, the invention provides a nozzle by impregnating a baked product forming a nozzle for steel making, which is mainly composed of completely- and/or partially-stabilized zirconia, with such a solution that allows unstabilized zirconia to be precipitated or separated by heat.

When the baked product impregnated with the solution is heated, unstabilized zirconia is precipitated or separated, and an open surface of a component particle of base material is coated by the unstabilized zirconia. As the open surface of component particles of the base material is coated by unstabilized zirconia, the component particles of base material are prevented from being in contact with the molten steel, and destabilization of the component particles of the base material is, therefore, reduced.

By impregnating only a working surface in a bore of a nozzle for steel making according to the above process, a nozzle for steel making can be manufactured at a lower cost.

BRIEF DESCRIPTION OF THE DRAWING

FIG. 1 illustrates a device for continuously casting a steel product.

DETAILED DESCRIPTION OF THE INVENTION

A nozzle according to the invention is a nozzle for steel making which is mainly composed of completely- and/or partly-stabilized zirconia, and is characterized in that a baked product, that is, a molded and baked nozzle is impregnated with a solution that allows unstabilized zirconia to be precipitated or separated by heat to achieve the object.

In a nozzle of the invention, a baked product impregnated with a solution is heated for allowing unstabilized zirconia to be precipitated or separated so that an open surface of a component particle of base material can be coated by the unstabilized zirconia.

Now, a process of heating the baked product impregnated with the solution may be, for example, special heating, preheating before actual application, heating in actual application, heating at the beginning of use or the like.

According to a nozzle of the invention, as an open surface of a component particle of base material is coated by unstabilized zirconia in such manner, the component particle of base material is prevented from being in contact with molten steel, and destabilization of the component particle of the base material is, therefore, reduced.

Further, by coating a surface of an individual component particle of base material in a working surface of a bore by unstabilized zirconia, a contact area between the coating layer and a surface of individual component particles of the base material is reduced, no separation is caused between the component particle of base material and the coating layer, and cracking of the coating layer is hardly caused. Moreover, even if such cracking is caused, since corrosion due to entrance of molten steel is limited to individual component particles of the base material that is located in a crack of the coating layer, only a part of the base material is corroded, and the structure is prevented from being fragile. Then, because of a synergistic operation of such effects, a corrosion resistance is increased.

Besides, it can be easily manufactured because it is not required to form a two-layered molding, and manufacturing at a low cost can be achieved since only a small amount of unstabilized zirconia, a relatively inexpensive material, is used.

The solution for precipitating or separating unstabilized zirconia by heat may be, for example, such an aqueous solution as zirconyl sulfate, zirconyl nitrate, zirconyl acetate and zirconyl ammonium carbonate or such solvent solution as zirconyl stearate and zirconyl octylate. A method for, impregnating a working surface of a bore with the solution will be described later.

A method for manufacturing a nozzle according to the invention is characterized in that a nozzle mainly composed of completely- or partially stabilized zirconia is molded and baked, then impregnated with a solution for precipitating or separating unstabilized zirconia by heat.

In such manner, a nozzle comprising a baked product which is impregnated with a solution that allows unstabilized zirconia to be precipitated or separated by heat according to the invention is obtained.

In the method for manufacturing a nozzle according to the invention, by subjecting the nozzle to such heating process as special heating, preheating before actual application, heating in actual application or heating at the beginning of use, unstabilized zirconia is precipitated or separated from the solution, and a nozzle coated by the unstabilized zirconia in an open surface of a component particle of base material can be obtained.

According to the method for manufacturing a nozzle according to the invention, a nozzle coated by the unstabilized zirconia in an open surface of a component particle of base material can be obtained in such a manner, and a nozzle hardly destabilized and having a high corrosion resistance can, therefore, be easily obtained at a low cost.

Although a nozzle coated by unstabilized zirconia in an open surface of a component particle of base material may be possibly produced by coating a component particle of base material with unstabilized zirconia beforehand, and molding a nozzle, using the component particle of base material in a working surface of a bore, in such case, as a surface of the particle is coated by unstabilized zirconia, sintering is difficult, and a stabilizer in stabilized zirconia is dispersed to the coating layer of unstabilized zirconia, if a sintering temperature or sintering time is increased, so that the effect of preventing contact between the component particle of the base material and molten steel of the coating layer may be affected.

In the method for manufacturing a nozzle according to the invention, although an entire surface of the nozzle may be impregnated with the solution, preferably, only such part as a working surface of a bore that is required to be prevented from being destabilized, and given a high corrosion resistance, that is, a predetermined part is impregnated with the solution for further reduction of a manufacturing cost.

As a method for impregnating a working surface of bore with the solution, for example, the bore may be filled with the solution by its own weight after a lower end of the bore is closed, the bore may be filled with the solution by means of pressure and/or sucking, the solution may be applied manually by using a brush, roller or the like, or the solution may be sprayed by an air spray. Among the methods, the method of filling the bore with the solution by means of pressure and/or sucking is recommended, as it facilitates control of a impregnating amount and depth of the solution.

In the invention, of course, a thickness of the coating layer can be increased so that a densified layer can be formed in a working surface of the bore by repetitive impregnation with the solution and precipitation or separation of unstabilized zirconia, in such a case, further prevention of destabilization and even higher corrosion resistance can be achieved by synergistic operation of densifying and coating effects.

In above case, a lower limit of impregnating amount of the solution [an impregnating amount of the solution/a volume of the void in a portion impregnated: a percentage of the void is generally 10 to 15%] is set at 1 g/cm$^3$ (impregnating weight of the solution of 0.5 g/cm$^3$), while an upper limit is not specifically set.

EXAMPLE

In a method for manufacturing a nozzle according to an embodiment of the invention, a nozzle was molded from zirconia which is partially stabilized by CaO at a percentage of void of 13%, the molding was baked, then once impregnated in a working surface of the bore thereof with an aqueous solution of 50% of zirconyl hydrochloride supplied at a pressure of 3 kgf/cm$^2$ for 5 sec., unstabilized zirconium was precipitated at 400° C. after the solution was dried, and the molding was thereafter baked again at 1300° C. Thus, a nozzle according to an embodiment of the invention, that is, a nozzle coated in a surface of a component particle of a base material in a working surface of bore thereof with unstabilized zirconia was obtained.

An impregnating amount of the solution was at 5 g/cm$^3$ (2.5 g/cm$^3$ when it is converted to an amount of zirconyl hydrochloride) [an impregnating amount of the solution/a volume of void in a portion impregnated].

As comparison examples, an unprocessed nozzle example ⑪, that is, a nozzle example formed of zirconia which is partially stabilized by CaO at a percentage of void of 13% and a nozzle example ⑫ similar to the unprocessed nozzle example with a coating layer (0.3 mm thick) of zirconia which is partially stabilized by CaO formed in a working surface of bore were formed.

A nozzle example ① dried after impregnation with the solution, another nozzle example ② subjected to preliminary baking at 400° C. 2, still other nozzle example ③ baked further at 1300° C., as mentioned above, and the comparison examples ⑪ and ⑫ were maintained in contact with a slag consisting of $SiO_2$ and MnO at 1550° C. for 3 hr. for a corrosion test, and a corrosion resistance of the nozzles was evaluated by the ratio of corrosion amount and shape of corrosion by setting a corrosion amount of the unprocessed nozzle at 100. Further, by X-ray analysis of the slag penetration layer, the ratio of destabilization from stabilized zirconia before the corrosion test was measured. The evaluations and a result of measurement are shown in Table 1.

TABLE 1

| Nozzle | | *Ratio of corrosion amount | Ratio of destabilization (%) | Shape of corrosion |
|---|---|---|---|---|
| Embodiments | Dried after impregnation of the solution | 78 | 24 | No separation and cracking |
| | Preliminarily baked at 400° C. | 76 | 25 | No separation and cracking |
| | Baked at 1300° C. | 75 | 22 | No separation and cracking |
| Comparison examples | Unprocessed | 100 | 89 | No separation and cracking |
| | Spray coating | 76–98 | 23–83 | Separation of coating layer due to internal corrosion; amount of corrosion partially increased. |

*:Ratio of corrosion amount when a corrosion amount of the unprocessed nozzle is set at 100.

As shown in Table 1, in embodiments with a coating layer formed in a surface of component particle of a base material by means of impregnation of the solution according to the invention, it is found that the ratio of destabilization is, in any case, lower than that of the unprocessed nozzle of comparison example, the corrosion amount is reduced, and the corrosion resistance is increased. It is also recognized that internal corrosion is caused due to separation of the coating layer and destabilization of the base material in the nozzle formed with a spray coating layer of comparison example, while the ratio of destabilization is low, and no separation and cracking is caused in the embodiments of the invention.

When a similar test was conducted by preparing samples alternative to the samples ①, ② and ③, using an impregnating pressure of zirconyl hydrochloride same as that described above, a concentration of solution of 30% and an impregnating amount of the solution of 3 g/cm$^3$ (1.5 g/cm$^3$ when it is converted to the amount of zirconyl hydrochloride), the ratio of corrosion was found to be at about 80, the ratio of destabilization at about 30%, thus the samples also showed a sufficient result for practical use.

Further, when a similar test was conducted by preparing samples alternative to the samples ①, ② and ③, using an aqueous solution of 50% of zirconyl sulfate, an impregnating pressure of 3 kgf/cm$^2$, an impregnating amount of the zirconyl sulfate solution of 5 g/cm$^3$ (2.5 g/cm$^3$ when it is converted to an amount of zirconyl sulfate), and using zirconyl sulfate also as a spray coating material corresponding to that of the comparison example ⑫, a result generally similar to that of Table 1 was obtained.

An upper limit of an impregnating amount of solution is not specifically set. In other words, when a sample prepared by repeating impregnation at a pressure of 3 kg/cm$^2$ and drying three times, using various solutions described above at a concentration of 50%, as a result, the ratio of corrosion was at about 65, and the ratio of destabilization at about 20. When the pressure applied during impregnation of the solutions of 50% in concentration was set at 5 kgf/cm$^2$ (a coating process was conducted once), a coating layer was of about 0.5 mm, and a result obtained was even better, such that the ratio of corrosion at about 70, and the ratio of destabilization at about 20.

As described above, in a nozzle coated in an open surface of a component particle of base material with unstabilized zirconia according to the invention, because the component particle of base material in a working surface of bore is coated with unstabilized zirconia, it is not required to form a two-layered molding, a nozzle can be easily manufactured, and a nozzle for steel making, particularly a funnel type nozzle can be produced at a low cost, since only a small amount of unstabilized zirconia is required.

Because the coating layer prevents a stabilizer contained in the component particle of base material from being in contact with molten steel and/or slag, even when CaO and MgO are used as the stabilizer, destabilization of the component particle of base material can be avoided.

Besides, as a contact area between individual component particles and the coating layer is small, no separation and cracking is caused in the coating layer, internal corrosion due to entrance of molten steel is prevented, and a corrosion resistance can be increased.

In a nozzle impregnated in a working surface of a bore with a solution that allows unstabilized zirconia to be precipitated or separated by heat according to the invention, by subjecting the nozzle to a special heating process, preliminary baking, preheating before use, heating during use or the like, unstabilized zirconia is precipitated or separated, and a surface of individual component particles of a base material in a working surface of the bore can be coated thereby, so that an effect similar to that of a nozzle coated in a surface of a component particle of base material in a working surface of a bore with unstabilized zirconia according to the invention can be obtained.

In a method for manufacturing a nozzle according to the invention, because a nozzle mainly composed of completely- or partially-stabilized zirconia for steel making is molded and baked, then impregnated with a solution that allows unstabilized zirconia to be precipitated or separated by heat in an open surface of a component particle of the base material, a nozzle coated in the open surface of component particles of the base material with unstabilized zirconia can be obtained by subsequently subjecting it to such heating process as special heating, preliminary baking, preheating before use and heating during use.

In addition, it is not required to form a two-layered molding, thus production of a nozzle can be facilitated, and a nozzle according to the invention can be obtained at a low cost, because only a small amount of unstabilized zirconia is required. In a method for manufacturing a nozzle according to the invention, in the case a surface of a component of base material is coated with unstabilized zirconia by molding and baking the nozzle for steel making, then impregnating it with a solution that allows unstabilized zirconia to be precipitated or separated by heat, and further allowing unstabilized zirconia to be precipitated or separated from the solution by a heat process, a nozzle coated in an open surface of a component particle of base material with unstabilized zirconia can be obtained.

In a method for manufacturing a nozzle according to the invention, a manufacturing cost can be further reduced in the case of a solution that allows unstabilized zirconia to be precipitated or separated by heat is applied through a working surface of a bore.

Moreover, in a method for manufacturing a nozzle according to the invention, a manufacturing cost is still further reduced in the case the solution is applied only to a working surface of a bore.

The foregoing relates to preferred exemplary embodiments of the invention, it being understood that other variants and embodiments thereof are possible within the spirit and scope of the invention, the latter being defined by the appended claims.

We claim:

1. A nozzle mainly composed of completely or partially-stabilized zirconia for steel making, consisting essentially of a baked product impregnated with an aqueous solution selected from a group consisting of zirconyl hydrochloride, zirconyl sulfate, zirconyl nitrate, and zirconyl ammonium carbonate, or a solvent solution of zirconyl stearate and zirconyl octylate, that allows unstabilized zirconia to be precipitated or separated by heat.

2. A nozzle for steel making of claim 1, wherein the baked product impregnated with the solution is heated so that unstabilized zirconia is precipitated or separated from the solution, and an open surface of a component particle of base material is coated with the unstabilized zirconia.

3. A nozzle for steel making of claim 1, wherein an impregnating amount of solid matter precipitated or separated from either one of zirconyl hydrochloride, zirconyl nitrate, zirconyl ammonium carbonate, zirconyl stearate and zirconyl octylate in which the concentration of the solution in the baked product is 0.5 g/cm$^3$ or more depending on the concentration of the solution.

4. A method for manufacturing a nozzle for steel making including steps of molding a nozzle for steel making that is mainly composed of completely or partially stabilized zirconia, baking it, then impregnating it with a solution selected from a group consisting of zirconyl hydrochloride, zirconyl sulfate, zirconyl nitrate, and zirconyl ammonium carbonate, or a solvent solution of zirconyl stearate and zirconyl octylate.

5. A method for manufacturing a nozzle for steel making, wherein a surface of a component particle of base material is coated with unstabilized zirconia by allowing unstabilized zirconia to be precipitated or separated from the solution by a heating process after the nozzle is impregnated with the solution wherein the solution is selected from a group consisting of zirconyl hydrochloride, zirconyl nitrate, zirconyl ammonium carbonate, zirconyl stearate and zirconyl octylate.

6. A method for manufacturing a nozzle for steel making of claim 5, wherein the solution is applied only to a working surface of bore.

7. A method for manufacturing a nozzle for steel making of claim 4, wherein the solution is at least one of zirconyl hydrochloride, zirconyl nitrate, zirconyl acetate, zirconyl ammonium carbonate, zirconyl stearate and zirconyl octylate.

8. A method for manufacturing a nozzle for steel making of claim 5, wherein an impregnating amount of solid matter of one of zirconyl hydrochloride, zirconyl nitrate, zirconyl ammonium carbonate, zirconyl stearate and zirconyl octylate in which the concentration of the solution in the baked product is 0.5 g/cm$^3$ or more depending on the concentration of the solution.

* * * * *